US005660290A

United States Patent [19]

Hayes

[11] Patent Number: 5,660,290

[45] Date of Patent: Aug. 26, 1997

[54] CLOSURE FITTING FOR UNTHREADED CONTAINERS

[75] Inventor: Thomas H. Hayes, Loveland, Ohio

[73] Assignee: CarnaudMetalbox (Holdings) USA Inc., Wilmington, Del.

[21] Appl. No.: 623,334

[22] Filed: Mar. 27, 1996

[51] Int. Cl.[6] ..... B65D 41/47

[52] U.S. Cl. ..... 215/252; 215/276; 215/318; 53/485; 53/420

[58] Field of Search ..... 215/318, 250, 215/252, 256, 274, 276, 306, 235, 43, 44; 220/288, 214, 301, 289, 334, 375; 53/485, 420

[56] References Cited

U.S. PATENT DOCUMENTS

| | | |
|---|---|---|
| 2,136,545 | 11/1938 | Gibbs . |
| 3,145,868 | 8/1964 | Stengle, Jr. . |
| 3,603,472 | 9/1971 | Lecinski, Jr. et al. . |
| 3,677,431 | 7/1972 | Westfall . |
| 3,746,199 | 7/1973 | Hart et al. . |
| 4,604,853 | 8/1986 | Albrecht et al. . |
| 4,607,757 | 8/1986 | Lecinski . |
| 4,694,970 | 9/1987 | Hayes . |
| 5,020,679 | 6/1991 | Signorini . |

FOREIGN PATENT DOCUMENTS

| | | |
|---|---|---|
| 2148364 | 3/1973 | France . |

*Primary Examiner*—Allan N. Shoap
*Assistant Examiner*—Nathan Newhouse
*Attorney, Agent, or Firm*—Wood, Herron & Evans, L.L.P.

[57] ABSTRACT

A closure fitting is provided for a container which itself has no threads or other closure securing means formed on it. The fitting, which can be pressed down over the mouth of a container, provides its own securing means by which an outer, closure portion of the fitting can be removed from and resecured to an inner attachment portion which remains on the container after opening. The closure fitting may have a stretchable or distendable conical hoop molded inside a surrounding skirt. Cooperating sets of threads, lugs, or the like are formed on the outer face of the conical hoop and on the inner face of the skirt. In the closure as formed, the closure securing means of the hoop do not operably engage those of the skirt. They are progressively brought into cooperating engagement by stretching and enlarging the hoop outwardly as the closure fitting is press-fitted onto a container. The hoop is severably joined to the skirt; twisting or otherwise removing the skirt from the hoop in the first opening breaks the connections of the hoop to the skirt, so that the closure can be removed from the hoop. The closure can thereafter be used in the same manner as a conventional closure.

32 Claims, 5 Drawing Sheets

CLOSURE FITTING FOR UNTHREADED CONTAINERS

FIELD OF THE INVENTION

This invention relates to a resealable closure fitting for a container which does not itself have closure securing means.

BACKGROUND OF THE INVENTION

Conventionally, means for securing a closure on a container are formed in part on the closure and in remaining cooperating part on the container. Thus a closure may have inside threads that cooperate with outside threads on the finish of a container; or a closure may have lugs that cooperate with lugs or seats on a container; or a closure may have a bead designed to snap over a rib on a container. The need to form part of the securing means on the container usually increases mold or die cost as well as the amount of material required for the container. Further, the provision of securing means on a container limits that container to use with a particular type of closure, and vice versa.

Moreover, where the closure is of the twist-on, twist-off type, the commercial filling process is slowed by the need to twist the closures onto the containers. Press-on closures, that is, closures which are applied by downward press-on force rather than twisted on, can be applied much more quickly on a filling line than twist-on closures, but they do not generally provide as secure a seal. Press-on, pry-off closures also require more force for removal than twist-off closures, and once removed they do not reseal as effectively as twist-off closures.

Metal containers, for example, cans, are often formed without any threads or other securing means, as the result of which a screw-on closure, indeed any closure that will tightly reseal, cannot be applied to such containers.

OBJECTIVES OF THE INVENTION

It has been a primary objective of this invention to provide a press-on, resealable closure fitting which can be rapidly applied to a container which itself has no closure securing means on it, i.e., no threads, lugs, or snap bead.

It has been a further objective of the invention to provide a molded closure fitting having external closure securing means formed on a portion of the fitting which will remain on a container after application, and internal securing means formed on a closure portion which is readily removable from and resealable to the portion that remains on the container.

It has been another objective of the invention to provide a closure fitting which can be pressed onto a container having a cylindrical side wall and which, once applied, cannot be removed from the container without showing evidence of having been opened.

THE PRIOR ART

Stengle U.S. Pat. No. 3,145,868 and Licenski U.S. Pat. No. 3,603,472 show outwardly threaded rings which are press- or shrink-fitted onto unthreaded containers. The rings are formed separately from closure caps, the caps being screwed on after the rings have first been seated.

Westfall U.S. Pat. No. 3,677,431 shows a closure which is press-fitted onto a cylindrical sidewall of a can. A hoop is molded in the first stage of a two-stage forming operation, and a surrounding cap is then molded around the hoop, using the hoop as part of the mold for the cap. Threads are interengaged before the hoop is seated on the closure.

Hart et al U.S. Pat. No. 3,746,199 shows a snap-on closure for unthreaded containers, in which an inner plastic ring is snapped over the rim of the container and has threads on its outer surface for receiving a separate outer metal cover. A tamper evidencing band is provided which covers the skirt of the closure and prevents opening without the band first being torn off. The closure portions are separately formed.

Lecinski U.S. Pat. No. 4,607,757 shows another two-part press-on closure wherein an inner sleeve is press-fitted onto an unthreaded neck of a container, and is heat shrunk to secure it in place.

A closure having an outer skirt molded with a top core removal mold and having an insert disk is shown in Hayes U.S. Pat. No. 4,694,970. Signorini U.S. Pat. No. 5,020,679 shows a threaded counter cap which is slipped onto an unthreaded container from the bottom up to a stop bead adjacent the container rim. The cap has a stretchable set of threads.

BRIEF SUMMARY OF THE INVENTION

This invention comprises a closure fitting having an outer portion that provides a closure in use, and which is severably or releasably connected to a distendable inner portion that provides cooperating securing means on the container. The outer portion includes a skirt and a top panel. The distendable inner portion has a configuration which permits it to be expanded from a smaller initial as-molded shape, into an enlarged as-attached configuration in which it operably engages the skirt and enables the skirt to be removed from and later resecured on the inner portion. The inner portion is preferably generally conical (i.e., upwardly narrowing) and extends upwardly and inwardly within the skirt. The two portions of the fitting are preferably integrally molded, the inner portion preferably being connected to the outer portion along a line of weakness. In its expanded attached configuration the inner portion engages and non-rotatably grips the sidewall of the container. The inner portion presents an outwardly facing component of the container securing means, for example, outside threads, lugs, or a snap bead, formed on its outer surface. The cooperating inwardly facing component of the closure securing means (e.g., inside threads) are formed on an inner surface of the skirt. The respective securing means need not operably engage one another until the fitting has been applied to a container.

The container itself need not have any closure securing means formed on it; that is, it may have a cylindrical or unconfigured (e.g., unthreaded) side wall or finish. Calculations indicate that the amount of material saved by eliminating the need to form closure securing means on a container is significant; for containers made of plastic, millions of dollars of resin could be saved.

The closure fitting preferably is applied to a container by pressing it over the mouth of the container, to stretch the hoop or other distendable inner portion around the container. This expands the inner portion to a more nearly cylindrical shape that substantially conforms to the sidewall shape of that part of the container. (The distendable portion may have apertures, thin web areas, and/or slits to permit it to be distended without rupturing.) As the inner portion is distorted from a conical to a more cylindrical shape, the threads or other securing means on its outside surface are progressively expanded outwardly into engagement with the cooperating, inwardly facing securing means on the skirt. The connection between the inner and outer portions and/or the configuration of the threads, aligns the outside threads on the inner portion beneath the respective skirt (inside) threads.

The inner portion of the fitting is releasably secured to the outer portion, preferably by bridges or other severable connecting means which are sheared, broken, or otherwise severed when the outer portion is twisted relative to the inner portion in the first or initial opening of the closure. This separates the outer portion of the previously integral fitting, from the inner portion. The outer portion thereby becomes a separate closure while the inner portion thereafter remains on the container to provide closure securing means thereon. Moreover, the severing of the connection between the two may be used to provide evidence that the closure has been opened, i.e., tamper evidencing.

The fitting is preferably injection molded with a mold having a top removal mold core, that is, a core which is removed through a top opening of the fitting. The outer and inner portions are preferably formed simultaneously, although it is alternatively contemplated that they could be molded separately and then joined. A top or separate insert disk may thereafter be top loaded into the outer portion, that is, inserted into the opening from above the inner portion, to close the opening.

The closure top or insert disk may have a plastisol or other gasket-forming material applied to its lower face, for forming a seal around the container mouth. Alternatively, a gasket for sealing the container rim may be integrally molded as an upward extension of the inner portion, as a flexible gasket-forming sleeve which forms a pliable, deformable co-axial extension of the inner portion. Such a gasket preferably includes a series of flexible circumferential feather-edged ribs. When the container is filled and the closure fitting applied, the sleeve projects upwardly and inwardly over the container rim and the ribs are compressed between the container rim and the closure top to form a labyrinthine seal. Thus, the fitting may include integrally formed inside and outside securing means and, in addition, integrally molded sealing means for forming a seal with the container. This eliminates the need for a separately formed gasket on the closure top.

DESCRIPTION OF THE DRAWINGS

This invention can best be further described by reference to the accompanying drawings in which.

DETAILED DESCRIPTION

Figure 1:
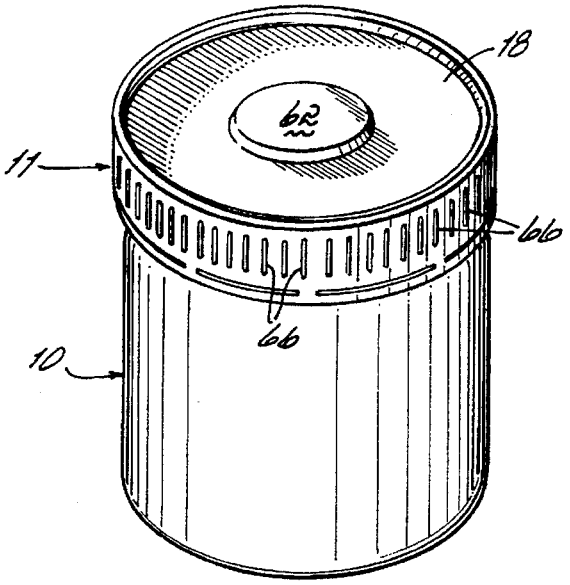
FIG. 1 is a perspective view of a container, shown for illustrative purposes as a metal can, to which has been applied a closure fitting in accordance with a preferred form of the invention.

FIG. 1 shows a container 10 to which a closure fitting 11 in accordance with a preferred embodiment of the invention has been applied. By way of example, fitting 11 is useful with glass containers, plastic containers (FIG. 4), and metal cans (FIG. 1). The container 10 need not be formed with any threads (or lugs or snap bead) for securing a closure on it, and may have a smooth, generally cylindrical finish 12 below its rim (see FIGS. 3 and 4). The rim 13 of the container may be conventional. An integral gasket or seal may be provided as part of the fitting, as will be described. It is preferred but not required that the container have one, or better two, axially spaced circumferential ribs or beads 15 and 16 (see FIG. 4) between which the closure inner portion is axially restrained, as will be described. These optional beads 15 and 16 need not stretch the fitting 10 after it has been installed; they may simply serve as locators or axial positioners for initially situating the fitting vertically on the container and thereafter retaining it in that position, as by preventing a stacked load on the top of a closure from pushing the inner portion downwardly on its container, and by making it virtually impossible to pull off the fitting without visible damage. If the container is a metal can, the upper locator bead 16 may for example be the conventional top chine of the can.

The preferred embodiment of the present closure fitting, as shown in the drawings, comprises a top which may be in the form of an insert disk 18 (FIG. 3); an outer portion in the form of a skirt 20; and a distendable or inner portion in the form of a continuous conical hoop 22 inside the skirt. The top and skirt are the closure portion of the fitting; when the fitting has been applied to a container the inside portion thereafter remains on the container, whereas the closure portion can be separated for opening and resealing.

Figure 2:
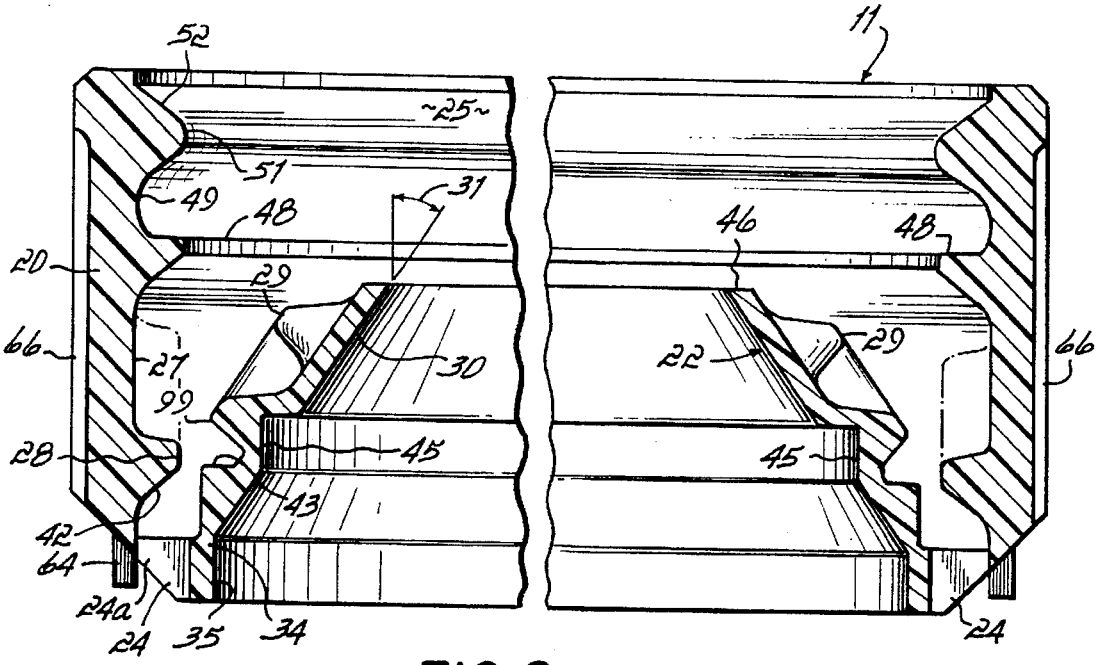
FIG. 2 is an enlarged axial section, partly broken away, of a preferred form of threaded closure fitting, showing the fitting as molded, prior to installing of an insert disk and prior to its application to a container.

As formed, hoop 22 is generally conical and projects angularly upwardly inside the skirt (see FIG. 2). As the fitting is being applied, the hoop is progressively stretched outwardly to an upright, more cylindrical and less conical configuration around the container, in which the inside portion operatively engages the skirt closure securing means (see FIGS. 3 and 4). As best seen in FIG. 2, the hoop has a lower portion 23 which is integrally but releasably joined to a lower portion 21 of the skirt, preferably at their lower edges by a series of severable circumferentially spaced bridges 24. The insert disk 18 may be formed separately of metal or plastic, and after molding is "top loaded" into the skirt, that is, snapped downwardly into a groove 49 around the center opening 25 in skirt 20, above hoop 22.

Figure 7:
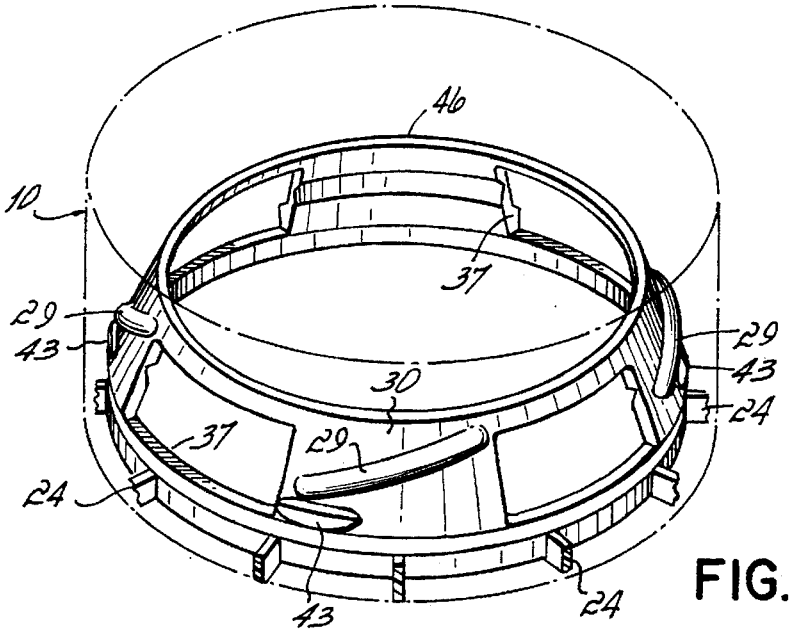
FIG. 7 is a perspective view, partly broken away, of a fitting having an inner portion in the form of a hoop having apertures to facilitate stretching during application, and having four-start threads.

Closure securing means are provided in the form of two cooperating components 28 and 29, formed respectively on the inside face of skirt 20 and on the outside face of hoop 22. (As used herein, the term "closure securing means" is intended to include threads, lugs, snap-on beads, and other cooperating securing means on the hoop and skirt.) In the preferred embodiment, skirt 20 has multiple lead threads 28 (inside threads) molded on its inside face 27. Inside threads 28 preferably are four separate circumferentially spaced threads, each extending approximately 75° of the circumference of the skirt (FIG. 7). Multiple lead threads provide more circumferentially uniform engagement of the inner and outer portions during press-on: the inside threads 28 of the skirt interfit with outside threads 29 formed on the outside face 30 of the hoop 22, as the filling is being applied.

Figure 4:
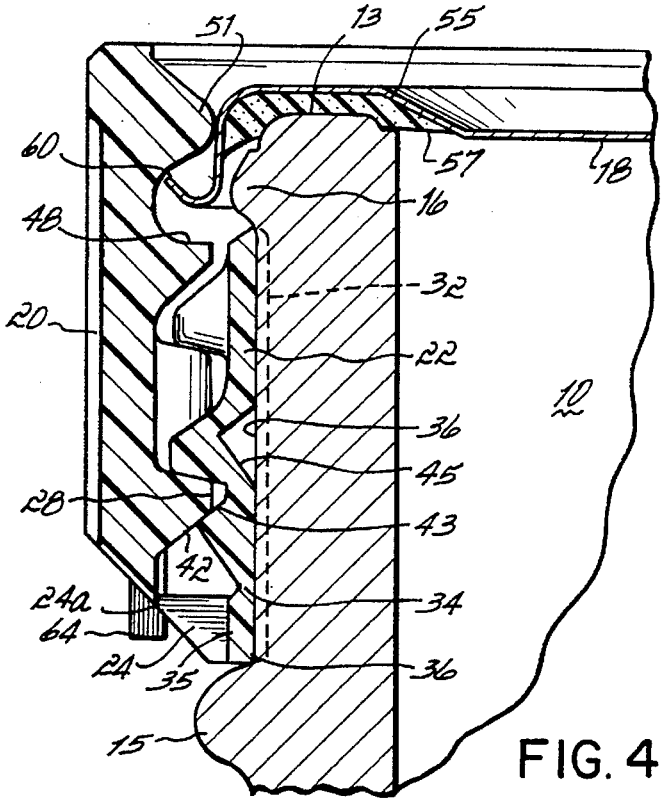
FIG. 4 is similar to FIG. 3 but shows the fitting in sealing configuration on the container, prior to initial opening.

The cooperating thread surfaces 28, 29 should be formed so that in the applied closure they are slightly inclined in the radial direction, see FIG. 4, for example at about 10°. This helps to cam them into alignment in case of initial axial misalignment when the fitting is being applied.

As shown in FIG. 2, the hoop as molded has a truncated, generally conical configuration, that is, it narrows toward its upper edge 46. It extends upwardly and inwardly above the bridges 24 that connect it to skirt 20 which surrounds it. The radial distance between the outside surface of the hoop and the inside surface of the skirt gradually increases in the upward direction, except at the threads. The top or inner edge 46 of the hoop lies below the closure top 18.

Figure 3:
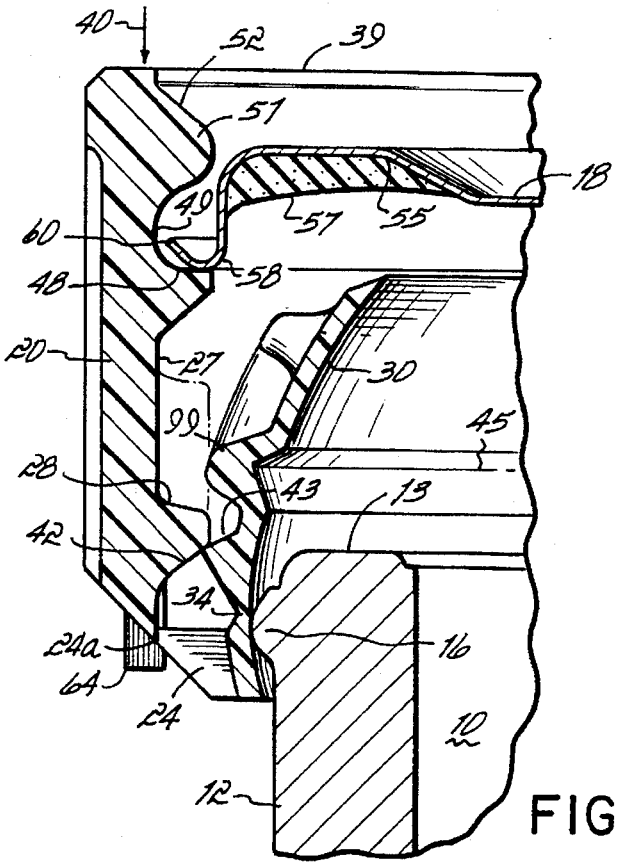
FIG. 3 is an enlarged section of a fitting of the type shown in FIG. 2 as it is being applied to a plastic or glass container, showing the inner portion being distended outwardly from a conical "as formed" configuration, into operating engagement with the outer or closure portion.

Because the hoop must be expanded, stretched, or otherwise distended from its as molded conical configuration into a more nearly cylindrical use configuration, as shown in FIGS. 3 and 4, so that its inside surface 30 will substantially facially engage the outside wall of the container, it should be made of a material and/or a configuration which can be spread outwardly during application without tearing or splitting. It should be noted that, instead of the continuous hoop shown, the closure inner portion may have tabs or flaps projecting upwardly and inwardly from a band. This arrangement may be useful if the stress on a continuous (un-flapped) hoop would be excessive. It is preferred that the hoop be of a thermoplastic which, once it has been distended and fitted to a container, "cold sets" in the distended position, so that the closure cannot thereafter be removed from the container by heating or prying the hoop off the container, without visible damage. Polypropylene is the preferred plastic material. The stretchability of such materials increases with heating, and for that reason it is preferred to apply the closure hot, so that the hoop can be distended with less danger of breaking. When cooled the material tends to set tightly so that it will not rotate with the skirt when the skirt is twisted to separate the closure. The hoop is in stretched engagement around the container, and surface friction by itself may be sufficient to prevent rotation. If necessary, an adhesive or a positive interlock such as longitudinal ribs can be provided on the container, as shown by phantom lines 32 (FIG. 4), to engage grooves or gaps 33 in the inside surface of the hoop (FIG. 7).

Figure 9:
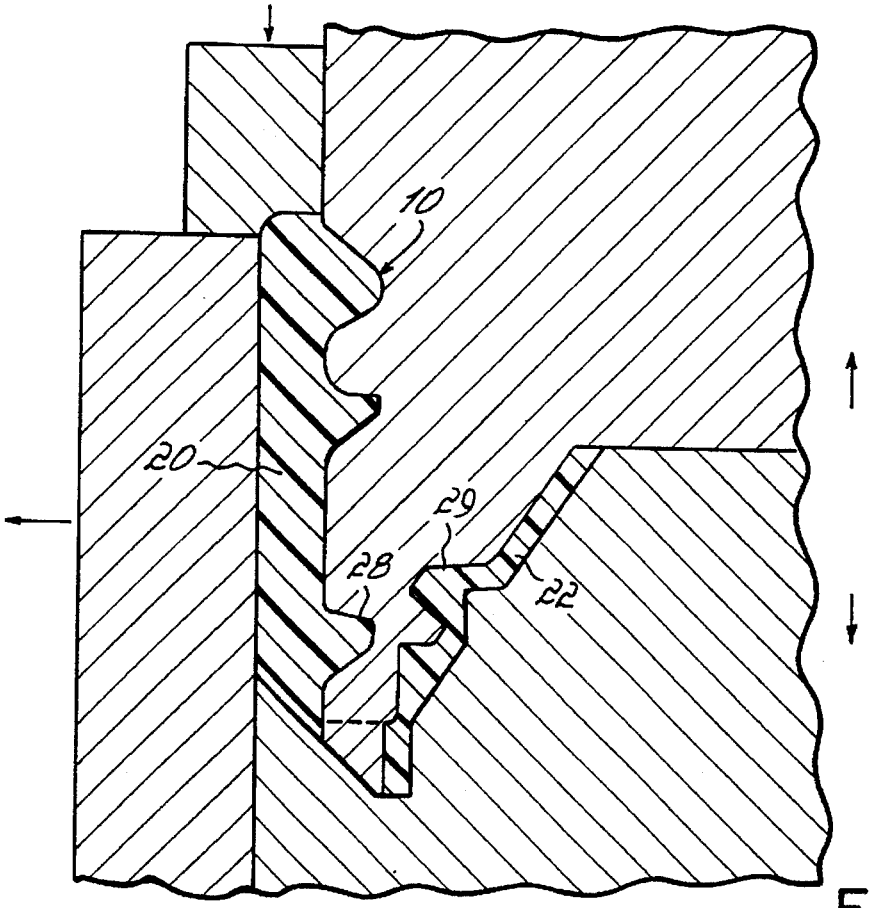
FIG. 9 is an enlarged partial axial section of a preferred form of mold for the fitting, the mold having a top removal core.

In the embodiment shown, face 30 of the hoop (FIG. 2) extends inwardly and upwardly at an angle 31 of approximately 35 degrees to the center axis of the closure, although the angle may differ, depending on the specific configuration and material. By reason of the angulation, the outside (hoop) threads 29 are initially spaced inwardly from the inside (skirt) threads 28 (FIG. 2). The threads are preferably undercut so that both sets can be simultaneously molded by using a top removal mold core, see FIG. 9 in which the movements of the mold sections are designated by arrows. At molding temperature the plastic can yield sufficiently that the threads 28, 29 on the fitting can be stripped from the corresponding cavities on the mold as the core is stripped from the hot molded fitting 10.

The area 34, adjacent the inner ends of the bridges 24, acts as a hinge about which the hoop can flex for application (FIG. 3). The bridges 24 may be triangular, having narrow outer ends **24*a* adjacent the skirt which will break upon first opening. Below hinge line 34 there is preferably a narrow (in the vertical direction), generally cylindrical band 35 having an inside face 36 with a diameter which permits fitting to the outside diameter of container bead 16. As the fitting is being pressed downwardly onto the container, past container bead 16 (FIG. 4), the conical hoop portion above hinge line 34 is progressively stretched outwardly by the container. It can be seen that the steeper the cone angle 31, the greater the stress on the hoop 22** as it is stretched outwardly, and correspondingly the more securely it will grip the container once in place.

Other factors being the same, the stress of stretching is relatively greater on a smaller diameter hoop than on a larger hoop, because the inner edge of a smaller hoop must undergo a greater percent elongation as it is distended through a given angle 31 than a larger hoop. I have found that if the tension on a hoop of given shape is so great as to tend to cause hoop cracking or splitting (with resulting loss of "grip" on the container), excessive tension can be relieved by providing two or more windows 37 or thinned areas within the hoop, as shown in FIG. 7. It is also contemplated that in some cases it may be useful to slit the upper edge of the closure inner portion, as indicated by dashed lines 39 in FIG. 7, to form tabs which will straddle ribs 32 on the container to relieve hoop stress while still preventing rotation.

The fitting 11 is applied to a container 10 by applying a pushing force (arrow 40 in FIG. 3) on the upper edge 39 of the closure skirt 20. This force is transmitted downwardly through the skirt to the hoop. It may also be useful to slightly turn or twist the fitting, in the direction opposite to the helix of the threads, as it is pushed on. If a large pushing force were transmitted through the bridges 24 to the hoop, the bridges could be prematurely broken. If necessary to overcome that possibility, spaced apart upwardly facing bosses or ledges 43 may be formed on the hoop outside face 30 (FIG. 3), positioned to be engaged by the lower ends 42 of the skirt threads (or other skirt abutments) as the fitting is being pressed on. Outward deformation of the hoop during application brings hoop ledges 43 directly beneath the lower ends 42 of the skirt threads, so that downward pushing force is transmitted through the facially engaging portions 42, 43. This "short circuits" the application of pushing force through the bridges and thereby reduces the chance of the bridges being broken during application of the fitting.

In order to reduce the volume of material in the fitting and to minimize shrinkage in cooling of relatively thick hoop sections after molding, a circumferential channel 45 may be formed on an inside face of the hoop (see FIG. 2). This also reduces the volume of material which must be distended during application of the hoop. The outside face of the skirt may have grooves 66, ribs or knurling by which it can be gripped for twisting.

Above the upper ends of its threading 28, skirt inside surface 27 has a disk lifting shoulder 48 which extends circumferentially around it, with an inwardly facing groove 49 above shoulder 48. Groove 49 lies below an inwardly projecting bead or rim 51, the inner edge of which defines the minimum diameter of skirt opening 25. The upper side of bead 51 is an angulated ramp 52, to facilitate press-in insertion of an insert disk 18. Containers holding food products are often vacuum packed, with the result that a net pressure force acts downwardly on the top of the disk to seal it on the rim; therefore rim 51 need not exert a substantial downward hold-down force on the disk. Such a pressure differential force on the disk must be overcome to break the vacuum and open the container. When the skirt is twisted to open the container, lifting shoulder 48 moves upwardly against disk gutter 58 to gradually lift the disk and thereby break the vacuum. Preferably the height of groove 49 is such that the disk can move axially or "float" in the groove, to sequence the breaking of a vacuum seal on the filled, sealed container.

Figure 5:
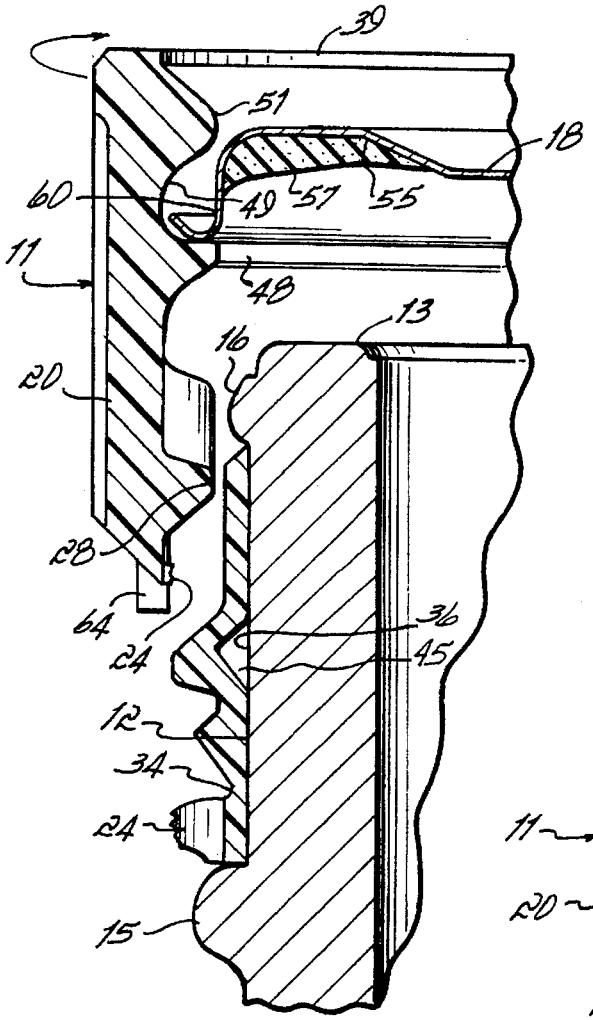
FIG. 5 is similar to FIG. 4 but shows the outer or closure portion as it is being twisted to separate it from the distended inner portion, which thereafter remains on the container.
Figure 6:
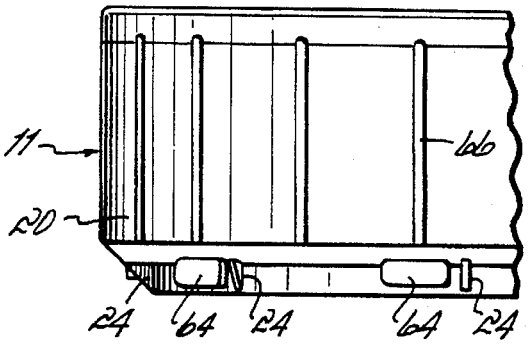
FIG. 6 is a fragmentary side elevation of the closure portion after it has been separated and removed from the inner portion, showing how the bridges may optionally be deformed to indicate that opening has occurred.

A preferred cross-sectional configuration for disk 18 is shown in FIGS. 3–5. The disk has downwardly opening annular channel 55 which in use is aligned radially with and overlaps container rim 13, and may receive a conventional gasket-forming material 57. The outer edge of the disk 18 is a gutter portion 58, "J"-shaped as seen in section, with an upturned outer rim 60. The disk 18 may have a so-called vacuum button 62 (FIG. 1), which pops up upon release of vacuum or initial opening to show that the container has been opened, as a means of providing additional tamper evidence. As can be seen in FIG. 2, the inwardly projecting hoop 22 blocks the insertion of top disk 18 from the bottom end of the closure; it is therefore preferred to snap in disk 18 from the top. Ramp 52 cams the upper edge of skirt 20 to yield outwardly as the disk 18 is pushed downwardly past rim 51 until disk outer edge 60 snaps into groove 49.

Although the embodiment shown has a top-load disk 18, it is alternatively contemplated that an integral top panel could be used. To provide a fitting having an integral top panel, the closure portion could be molded separately from the hoop portion, then joined; or the hoop could be molded in a "down" position, then inverted to an "up" position prior to installation on a container.

Figure 10:
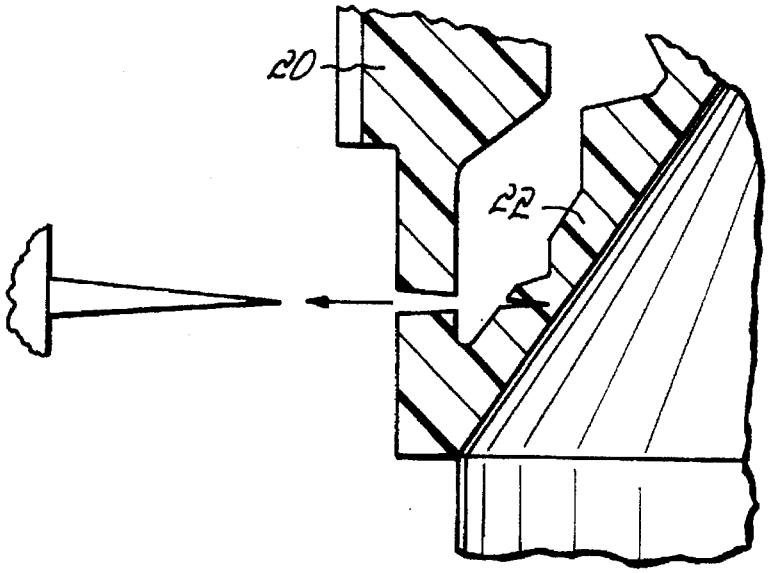
FIG. 10 is an enlarged partial section showing one method of cutting, rather than molding, frangible bridges.

The bridges 24 are preferably triangularly shaped, having a narrowest dimension at their outward ends 24*a* where they join the skirt 20. FIG. 10 shows an alternative form of bridges, formed along a line incised by a wheel which cuts at intervals through the skirt and into the hoop. Twisting the skirt relative to the non-rotatable hoop breaks the bridges at their weakest point. To increase the visibility of the bridges once broken, i.e., to improve tamper-evidence, it is preferred to provide downwardly extending "pegs" or bridge-benders 64 at the bottom of the skirt, adjacent each bridge. When the skirt is rotated immediately after the bridges are first broken, the pegs 64 wipe across the broken ends of the bridges and bend them aside circumferentially. This tends to permanently deform the bridge ends in a manner which makes them more visible (see FIG. 5). Instead of bridges, other forms of severable connections can be used, such as a tear band or a scored line around the fitting.

Figure 11:
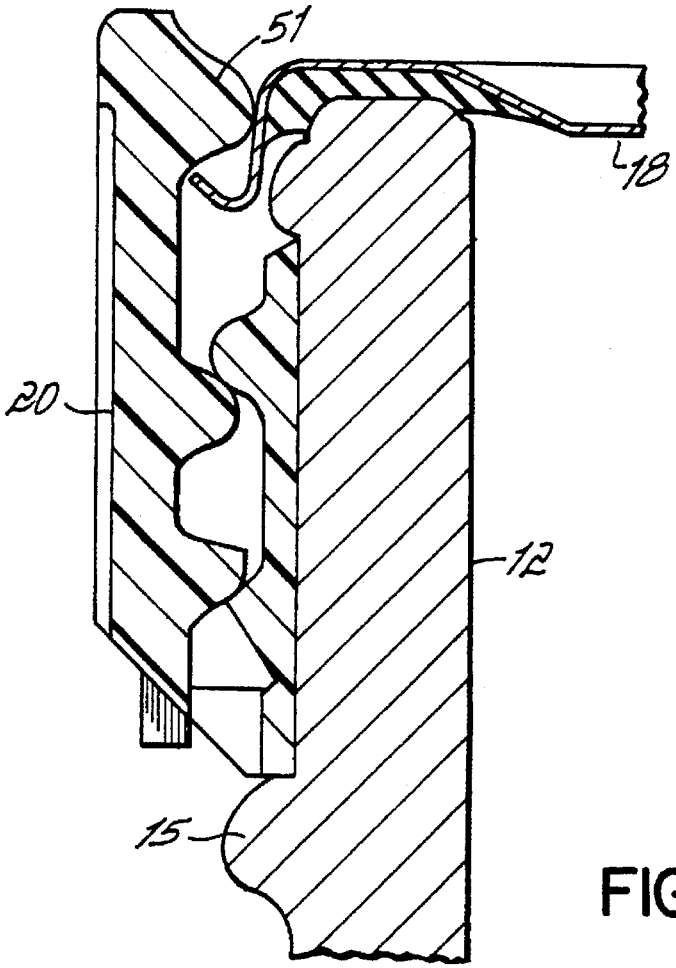
FIG. 11 is a partial axial section similar to FIG. 4, but shows an embodiment in the form of a press on-pry off closure having a snap rib rather than threads to secure the hoop.

FIG. 11 shows an alternative embodiment wherein the closure securing means comprise a circumferential snap ring 70 on the closure and an annular bead 72 on the inner portion.

Once opened, the closure can be tightly resealed on a container which itself has no securing means, just as a conventional closure can be secured on a container with preformed securing means.

Figure 8A:
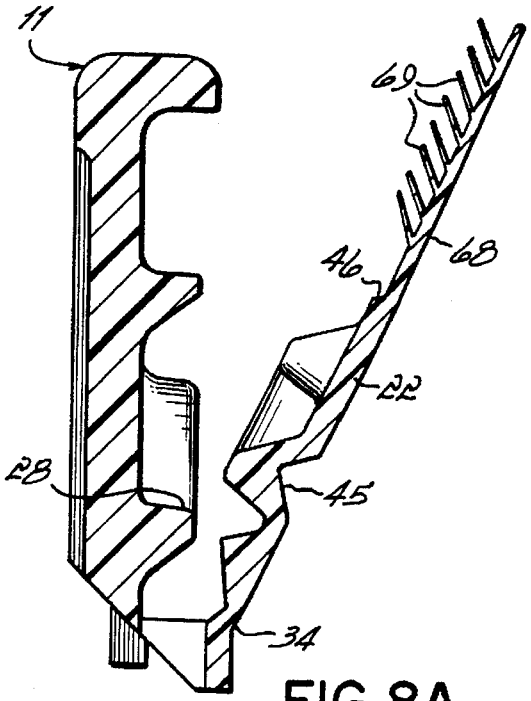
FIG. 8A is an enlarged partial section similar to FIG. 2, but shows a modified form of fitting wherein the inner portion has integral container rim sealing means.
Figure 8B:
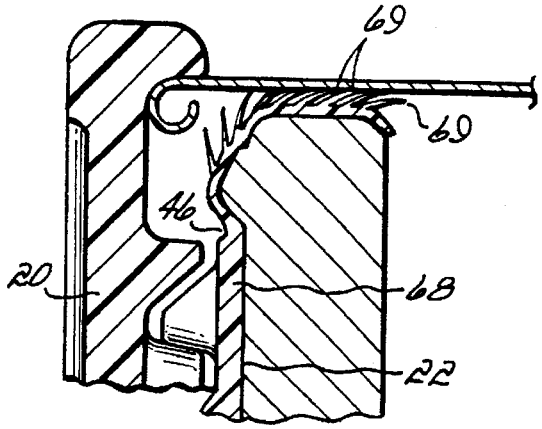
FIG. 8B shows the fitting of FIG. 8A as applied to a container and forming a seal with the container rim.

As an option, a labyrinthine seal or gasket 68 may be formed as an extension from the upper edge of the hoop, see FIGS. 8*a* and 8*b*. The seal is annular and has "feathers" or fine ribs 69 on one or both sides which are deformed in use between top 18 and container rim 13. This eliminates need for an applied plastisol or other gasket; the seal is formed as an incident to the application of the fitting to the container.

While the fitting 11 has been shown with a inside surface which is of circular cross-section, it should be noted that the hoop could alternatively have a polygonal inside surface, for use on a container having a similar polygonal sidewall. In other words, the hoop inside surface can be shaped for use on a container of non-circular section. Further, in the case of a press-on, pry-off closure, the closure itself need not be circular in cross section.

From what has been said it can be seen that the fitting herein disclosed enables a resealable closure to be applied to a container which itself has no securing means, even to a container with an unconfigured or straight cylindrical finish or sidewall. The fitting can be applied by a simple press-on operation, and may include an integrally formed resealable seal and/or tamper evidencing feature. No other known closure possesses its combination of features.

Having described my invention, what is claimed is:

1. A closure fitting for a container comprising, a top;

a skirt depending from said top and presenting inside closure securing means on an inner surface thereof; and a distendable portion within said skirt and projecting inwardly;

said distendable portion connected to said skirt by a severable connection, said distendable portion having an inner surface, an outer surface, and outside closure securing means formed on said outer surface and cooperable with said inside closure securing means, said distendable portion adapted to be distended outwardly when its said inner surface is pressed around the end of a container, such pressing bringing said inside and outside closure securing means into operating engagement with one another, the respective securing means of said distendable portion and said skirt being cooperable, when engaged with one another on said container, for removing said skirt from said container.

2. The closure fitting of claim 1 wherein said distendable portion is formed integrally with said skirt.

3. The closure fitting of claim 1 wherein said distendable portion is generally conical and is outwardly stretchable.

4. The closure fitting of claim 3 wherein said distendable portion is a hoop and has windows or slits to relieve hoop stress arising from distension when applied to a container.

5. The closure fitting of claim 1 wherein said closure securing means comprise outside threads on said outer surface of said distendable portion and inside threads on said inner surface of said skirt.

6. The closure fitting of claim 1 wherein said distendable portion projects upwardly toward said top.

7. The closure fitting of claim 1 wherein said top is formed separately from said skirt.

8. The closure fitting of claim 1 further comprising at least one boss on said distendable portion and positioned for engagement by said securing means of said skirt when downward force is applied to said skirt during application of said fitting to a container, so that said skirt transmits downward force to said distendable portion, through said boss.

9. The closure fitting of claim 1 wherein said severable connection of said distendable portion to said skirt comprises bridges.

10. The closure fitting of claim 9 wherein said bridges extend radially between said distendable portion and said skirt.

11. The closure fitting of claim 9 wherein said bridges are separated by circumferential gaps between them.

12. The closure fitting of claim 9 further comprising pegs projecting downwardly from said skirt adjacent said bridges, said pegs positioned to abut said bridges as said skirt is rotated, such abutting deforming the bridges and thereby making their breakage more easily visible.

13. The closure fitting of claim 1 wherein said inside surface of said distendable portion is distended into a substantially cylindrical shape when said fitting is pressed onto a container.

14. The closure fitting of claim 1 wherein said distendable portion includes tabs separated by slits, to accommodate outward deformation in application.

15. A closure fitting for a container comprising, a top;

a skirt depending from said top; and a generally conical hoop within said skirt and below said top, said hoop severably connected to said skirt, said skirt having an inner surface presenting inside closure securing means thereon, said hoop having an outer surface presenting outside closure securing means, and an inner surface which as formed extends angularly inwardly and upwardly, said hoop adapted to be distended outwardly by pressing said fitting over a container to fit said inner surface of said hoop around the container, such pressing also bringing the respective securing means of said hoop and skirt into operating engagement with one another, the respective securing means of said hoop and skirt being cooperable, when so engaged with one another, to enable said skirt to be removed from said hoop and to sever said connection of said hoop to said skirt.

16. The closure fitting of claim 15 wherein said securing means comprises at least one outside thread on said hoop outer surface and at least one cooperable inside thread on said skirt inner surface.

17. The closure fitting of claim 15 further including abutment means formed in part on said hoop and in cooperating part on said skirt to interengage and transmit press-on force from said skirt to said hoop during application of said fitting to a container.

18. The closure fitting of claim 15 further comprising a flexible annular seal extending from and above a distal end of said hoop, said seal configured to overlie the rim of a container when said fitting has been applied to the container and to form a seal by and between said top and said container rim.

19. The closure fitting of claim 18 further wherein said seal has flexible ribs which in use are squeezed between said top and said rim of said container to provide a labyrinthine seal.

20. The closure fitting of claim 15 wherein said top is a separately formed disk which is fitted into said skirt.

21. The closure fitting of claim 20 further wherein said disk is fitted into a top opening in said skirt, said skirt has an inwardly projecting lip which surrounds said opening, and said disk is retained within said opening by said lip.

22. The closure fitting of claim 21 wherein said disk is press-fitted past said lip into said opening, and above said closure securing means on said skirt.

23. The closure fitting of claim 20 wherein said disk is axially movable within said opening, and in use is lifted by said skirt when said skirt is being removed from a container.

24. A closure fitting comprising, a top;

a skirt depending from said top and presenting inside closure securing means on an inner face thereof; and a distendable portion within said skirt and connected by a severable connection to said skirt, said distendable portion having an inside surface which as formed extends inwardly and upwardly, and outside closure securing means formed on an outer face thereof, said distendable portion adapted to be distended outwardly to bring its said inside surface substantially into facial engagement with a sidewall of a container by pressing said fitting axially onto a container, such pressing bringing the respective securing means of said distendable portion and skirt into operable engagement with one another, and pressing force-transmitting abutments provided in part on said skirt and in part on said distendable portion, said abutments on said distendable portion being brought into position to be engaged by the abutments on said skirt upon outward distension of said distendable portion when pressed onto a container.

25. A method of providing a resealable closure on a container, comprising, forming a closure fitting having a top, a skirt depending circumferentially from said top, and a distendable portion inside and severably connected to said skirt, providing closure securing means in part on an inner surface of said skirt and in part on an outer surface of said distendable portion, said distendable portion having an inside surface which extends inwardly and upwardly, and applying said closure fitting to a container by pressing it axially onto said container, said container distending said distendable portion outwardly and bringing the closure securing means thereon into operable engagement with the closure securing means of said skirt.

26. The method of claim 25 further comprising, providing a top opening in said skirt, forming said closure securing means on said skirt and on said distendable portion by a mold member which after molding is removed through said top opening, and inserting a top disk in said opening to close said opening.

27. The method of claim 26 including the step of providing an inward projection on said skirt positioned to be brought into abutting engagement with an upwardly facing abutment on said distendable portion, to transmit said force axially from said skirt through said abutment.

28. The method of claim 27 further comprising, applying said fitting at a temperature sufficiently hot to enhance the flexibility of said distendable portion to permit it to be distended by said container, and cooling said fitting after application to said container, said distendable portion thereafter fitting so tightly around said container so that it cannot rotate thereon or be removed in an axial direction.

29. A method of providing a resealable closure on a container having no closure securing means formed thereon, comprising, farming a fitting having a top, a skirt depending from said top, and a generally conical hoop within said skirt, said hoop having an inside surface which extends inwardly and upwardly, connecting the hoop the skirt by a severable connection adapted to break upon first opening of the closure, providing closure securing means in part on an inner surface of said skirt and in part on an outer surface of said hoop, and applying said closure fitting to said container by pressing said fitting axially onto said container so that said container engages said inside surface of said hoop and distends said hoop outwardly and brings the closure securing means on the hoop into operable engagement with the closure securing means on the skirt.

30. The method of claim 29 comprising the further steps of, twisting the skirt about the hoop to break said severable connection, so that said skirt and top can then be removed from said container.

31. The method of claim 29 further comprising, forming a gasket integrally with said hoop, said gasket being a flexible sleeve extending from an upper edge of said hoop and having compressible seal-forming surfaces integrally formed thereon, and compressing said surfaces between said top and a rim of said container to form a seal as said fitting is being applied to said container.

32. A method of providing a resealable closure for a container which has no closure securing means, comprising, forming a closure fitting comprising a top, a skirt depending from said top, and a generally conical hoop within and connected integrally to said skirt, said hoop extending angularly inwardly and upwardly within the skirt, connecting said hoop to said skirt by a severable connection adapted to break upon first opening of the closure, providing closure securing means in part on an inner surface of said skirt and in part on an outer surface of said hoop, the hoop securing means as formed being spaced from the skirt securing means, and distending said hoop outwardly by pressing said fitting over the end of said container and thereby bringing said hoop securing means into operable engagement with said skirt securing means.

* * * * *

UNITED STATES PATENT AND TRADEMARK OFFICE

CERTIFICATE OF CORRECTION

PATENT NO. : 5,660,290
DATED : August 26, 1997
INVENTOR(S) : Thomas H. Hayes

It is certified that error appears in the above-indentified patent and that said Letters Patent is hereby corrected as shown below:

At column 10, line 59, "farming" should be --forming--.

At column 10, line 63, insert --to-- after "hoop" and before "the".

Signed and Sealed this

Tenth Day of February, 1998

*Attest:*

*Attesting Officer*

BRUCE LEHMAN

*Commissioner of Patents and Trademarks*